US011702796B2

(12) United States Patent
Gissing et al.

(10) Patent No.: US 11,702,796 B2
(45) Date of Patent: Jul. 18, 2023

(54) DEVICE AND METHOD FOR PRODUCING A PULP WEB

(71) Applicant: ANDRITZ AG, Graz (AT)

(72) Inventors: Klaus Gissing, Gratwein-Strassengel (AT); Boris Jancic, Sladki Vrh (SI); Lukas Gissing, Gratwein-Strassengel (AT)

(73) Assignee: ANDRITZ AG, Graz (AT)

( * ) Notice: Subject to any disclaimer, the term of this patent is extended or adjusted under 35 U.S.C. 154(b) by 0 days.

(21) Appl. No.: 17/793,694

(22) PCT Filed: Dec. 11, 2020

(86) PCT No.: PCT/EP2020/085678
§ 371 (c)(1),
(2) Date: Jul. 19, 2022

(87) PCT Pub. No.: WO2021/170278
PCT Pub. Date: Sep. 2, 2021

(65) Prior Publication Data

US 2023/0064891 A1 Mar. 2, 2023

(30) Foreign Application Priority Data

Feb. 25, 2020 (AT) ..... A 50138/2020

(51) Int. Cl.
*D21F 9/00* (2006.01)
*D21F 11/02* (2006.01)
(Continued)

(52) U.S. Cl.
CPC ..... *D21F 9/003* (2013.01); *D21F 2/00* (2013.01); *D21F 3/08* (2013.01); *D21F 5/182* (2013.01);
(Continued)

(58) Field of Classification Search
CPC . D21F 9/003; D21F 9/02; D21F 11/02; D21F 5/18; D21F 11/14; D21F 11/145; D21F 2/00
(Continued)

(56) References Cited

U.S. PATENT DOCUMENTS 5,865,955 A 2/1999 Ilvespaa et al.
8,349,138 B2 1/2013 Mausser et al.
(Continued)

FOREIGN PATENT DOCUMENTS

CA 3091525 * 9/2019 ..... D21F 1/52
DE 2805494 A1 1/1979
(Continued)

OTHER PUBLICATIONS

International Search Report dated Apr. 6, 2021 for International Patent Application No. PCT/EP2020/085678.
(Continued)

*Primary Examiner* — Eric Hug
(74) *Attorney, Agent, or Firm* — Alix, Yale & Ristas, LLP

(57) ABSTRACT

The invention relates to a method and a device for drying a pulp web, with dewatering of the pulp web by pressing and the pulp web being guided directly on the press belt to a first transfer area for transfer of the pulp web to a transfer clothing and transfer of the pulp web in a second transfer area to a dryer. It is characterized in that the pulp web undergoes thermal drying between the first transfer area and the second transfer area. This enables production of a pulp web with improved quality characteristics and low energy consumption at the same time.

14 Claims, 2 Drawing Sheets

(51) Int. Cl.

| | |
|---|---|
| ***D21F 11/14*** | (2006.01) |
| ***D21F 5/18*** | (2006.01) |
| ***D21F 2/00*** | (2006.01) |
| ***D21F 3/08*** | (2006.01) |
| ***D21F 7/12*** | (2006.01) |

(52) U.S. Cl.
CPC ..... *D21F 7/12* (2013.01); *D21F 11/02* (2013.01); *D21F 11/145* (2013.01)

(58) Field of Classification Search
USPC ..... 162/109
See application file for complete search history.

(56) References Cited

U.S. PATENT DOCUMENTS

| | | | | |
|---|---|---|---|---|
| 10,927,502 | B2 | 2/2021 | Beck | |
| 2002/0088577 | A1 | 7/2002 | Watson et al. | |
| 2020/0378068 | A1* | 12/2020 | Filippi | D21F 11/14 |
| 2021/0017707 | A1* | 1/2021 | Sealey, II | D21F 11/006 |
| 2021/0246613 | A1* | 8/2021 | Aronsson | D21F 3/0227 |

FOREIGN PATENT DOCUMENTS

| | | | |
|---|---|---|---|
| WO | 9713031 | A1 | 4/1997 |
| WO | 2017139125 | A1 | 8/2017 |

OTHER PUBLICATIONS

International Preliminary Report on Patentability dated Jan. 26, 2022 for International Patent Application No. PCT/EP2020/085678.

* cited by examiner

DEVICE AND METHOD FOR PRODUCING A PULP WEB

BACKGROUND

The disclosed embodiments relate to a method for producing a pulp web, especially a tissue or sanitary paper web, with first dewatering of the pulp web by pressing, the pulp web being pressed in a first pressing area between a first clothing, the first clothing being a felt, and a rotating press belt with line loads between 80 kN/m and 600 kN/m and the pulp web being transferred to the rotating press belt, with the pulp web being guided directly on the press belt out of the first pressing area to a first transfer area, with transfer of the pulp web in the first transfer area from the rotating press belt to a transfer clothing and transfer of the pulp web in a second transfer area from the transfer clothing to a drying cylinder. Also disclosed is a device for producing a pulp web.

In general, a pulp suspension is placed between two clothings via a headbox and dewatered centrifugally in order to produce a pulp web, especially a tissue or sanitary paper web. In tissue production in particular, the crescent former design is used, i.e. the pulp suspension is placed between a felt and a forming fabric and the pulp web is formed by dewatering of the pulp suspension. When the pulp web has formed, the forming fabric is lifted off the pulp web, the pulp web resting on the felt when it is fed to the next process steps, comprising other mechanical and/or thermal dewatering processes and winding on a reel as the final product.

In AT 508 331 A1, a method and a device are disclosed for treating a pulp web in a long-nip pressing unit. A method for producing tissue is provided in which dewatering and transport of the pulp web is achieved in a simple and compactly structured press arrangement.

DE 2805494 A1 refers to the press part of a wet web former for pulp or similar, comprising at least two consecutive pressing points, a pre-heater being disposed between the pressing points and the pre-heater operating such that the water from the pulp web does not evaporate to a significant extent.

WO2017139125A1 discloses a "molding roll" for making paper products, with a cylindrical shell, a vacuum box being disposed inside the cylindrical shell. Concerning the state of the art, FIG. 3 shows a paper machine with belt creping, the paper web being dewatered in a shoe press and fed through a vacuum box after belt creping, the vacuum permitting enlargement of the caliper of the paper web by sucking the paper web into the topography of the creping belt. In addition, FIG. 5 discloses a paper machine where the paper web is fed to a molding nip on a transfer fabric and then over the molding roll to a transfer nip.

US2002088577A1 discloses an impingement drying process to produce an absorbent pulp web and refers, in particular, to a method for producing an absorbent sheet that is dewatered without compression and dried by means of impingement drying.

D3 WO9713031A1 discloses a method in a paper machine, where a web is dewatered in at least one press nip and then dried in a dryer group.

SUMMARY

Provided herein is a method and device useful to produce a pulp web with improved pulp characteristics and with low energy consumption, low operating costs and low capital expenditure at the same time.

This is achieved in that the pulp web undergoes thermal drying between the first transfer area and the second transfer area. The pulp web is pressed in a first pressing area at line loads between 80 kN/m and 600 kN/m, the pulp web being pressed directly between the first clothing—a felt—and a rotating press belt. Here, the pulp web is transferred in the first pressing area from the first clothing to the rotating press belt and then out of the first pressing area—directly on the press belt—to a first transfer area. In the first transfer area, the pulp web is transferred from the rotating press belt to a transfer clothing. The quality characteristics of the pulp web are improved in this first transfer area when the pulp web is transferred to the transfer clothing, although the quality characteristics deteriorate again when the pulp web is transferred from the transfer clothing to the drying cylinder in the second transfer area. This deterioration results from pressing of the pulp web that does takes place when it is transferred from the transfer clothing to the drying cylinder. Surprisingly, it was noted that the quality characteristics of the pulp web can be retained better in the second transfer area if the dry content of the pulp web is increased further by means of thermal dewatering between the first transfer area and the second transfer area, making it possible to obtain improved quality characteristics overall in the pulp web. Here, the dryness of the pulp web after the first transfer area lies typically between 35% and 50%, the dryness being defined as the quotient of dry fiber mass and the sum of dry fiber mass and water mass. As a result of thermal drying of the pulp web between the first transfer area and the second transfer area, the dry content of the pulp web is increased by 3% to 10% in the second transfer area, these percentages again reflecting the dryness as defined above. Hence, if the pulp web has 42% dryness for example, it is possible to increase the dryness of the pulp web by approximately 1% (to 43%) by means of further thermal drying between the first transfer area and the second transfer area if the pulp web is dried over a length of 1 meter in machine direction. Linear scalability of drying over the drying length is likely in this dryness range.

A favourable embodiment is thus characterized in that the pulp web is structured in the first transfer area, this structuring of the pulp web taking place by transferring the pulp web from the rotating press belt, revolving at a higher speed, to the transfer clothing, revolving at a lower speed, and the transfer clothing being designed as a structured transfer clothing. This is advantageous because structuring of the pulp web in the first transfer area leads to an improvement in the quality characteristics of the pulp web, an improvement, i.e. an increase, being achieved in the thickness or bulk [$cm^3/g$], which is defined as the ratio between sheet thickness [mm] and sheet weight [$g/m^2$], of the pulp web due to its transfer from the rotating press belt, revolving at a higher speed, to the transfer clothing, revolving at a lower speed, and an improvement being achieved in water absorption in terms of water absorption capacity. Structured transfer clothings comprise such clothings as are typically used in TAD (through-air dryer) machines for through-air drying of the tissue web or sanitary paper web and thus, in particular, TAD drying wires.

Another favourable embodiment is characterized in that thermal drying of the pulp web on the transfer clothing comprises convection drying of the pulp web, drying air being applied directly to the pulp web by a drying device and the drying air then being sucked back into the drying device again. The pulp web carried on the transfer clothing after the first transfer area is dried advantageously by means of convection drying first of all, for example impact drying. As the pulp web has correspondingly lower initial permeability after the first transfer area, i.e. permeability for the drying air, convection drying is advantageous because hardly any or only a small part of the drying air flows through the pulp web carried on the transfer clothing. Thus, the drying air from the drying device is applied directly to the pulp web, the drying air being deflected when it hits the pulp web and the water evaporating out of the pulp web being absorbed by the drying air. The drying air is then sucked back into the drying device again. The drying device is typically designed as a dryer hood or impact dryer hood, the drying air typically being applied directly to the pulp web through slot-type or hole-type nozzles. The drying air from the dryer hood at a temperature between 100° C. and 150° C. and a blow-out speed between 60 m/s and 100 m/s is applied directly to the pulp web. The maximum temperature of the drying air is limited to 240° C. This limit results from the heat resistance of commonly used, structured transfer clothings. The structured transfer clothing could also be heat-resistant at higher temperatures if special synthetic materials were selected, but this would hardly be economical.

Another favourable is characterized in that thermal drying of the pulp web carried on the transfer clothing also comprises through-air drying of the pulp web, the drying air being applied through the drying device directly to the pulp web, a first part of the drying air being sucked back into the drying device again and a second part of the drying air being sucked through the pulp web into a suction device, the transfer clothing running between the pulp web and the suction device. After initial convection drying of the pulp web, there is typically an improvement in permeability, i.e. the permeability of the pulp web for the drying air, and thus better conditions for through-air drying of the pulp web. Here, the drying air from the drying device is applied directly to the pulp web in the area of through-air drying. When the drying air hits the pulp web, a first part of the drying air is deflected, the water evaporated out of the pulp web being absorbed by the drying air and then this first part of the drying air being sucked back into the drying device again. A second part of the drying air is sucked through the pulp web into a suction device, the pulp web being dried by the drying air as it flows through it. A suction device can be designed as a vacuum box or suction box, for example, or as a vacuum roll. As orientation—the first part of the drying air typically contains two-thirds or more of the drying air applied, and the second part of the drying air contains up to one third of the drying air applied. The drying device can comprise separate drying devices for convective drying and through-air drying, or it can be designed as a drying device for both convection and through-air drying. Once again, the drying air from the dryer hood, at a temperature between 100° C. and 150° C. and a blow-out speed between 60 m/s and 100 m/s, is applied directly to the pulp web.

An advantageous embodiment is characterized in that drying air is applied directly to the pulp web for thermal drying of the pulp web between the first transfer area and the second transfer area, the temperature of the drying air being set by direct and/or indirect use of process waste heat and the process waste heat being produced in thermal drying of the pulp web after the second transfer area and/or in sub-systems, particularly in a vacuum system. Advantageously, the energy efficiency of the overall plant is improved because process waste heat can be used. At the same time, the quality characteristics of the pulp web are improved due to the increase in dryness of the pulp web between the first transfer area and the second transfer area, which was not to be expected because improvements in quality characteristics very often go hand in hand with a deterioration in the energy efficiency of the overall plant. Process waste heat from thermal drying of the pulp web after the second transfer area and/or from sub-systems, particularly from a vacuum system, is appropriate as process waste heat that can be used here. Examples of thermal drying after the second transfer area are drying of the pulp web on a drying cylinder (for example a Yankee, i.e. a drying cylinder with a diameter of 1800 mm to 6000 mm), or high-temperature hood drying, the high-temperature drying hood being combined with the drying cylinder and enabling high-temperature convection drying of the pulp web on the drying cylinder. High-temperature convection drying refers here to drying with drying air at a temperature of more than 280° C. and typically in a range between 350° C. and 500° C., although temperatures of up to 650° C. can also be used. The waste heat from high-temperature hood drying has a lower temperature, the temperature of the waste heat being at least more than 200° C. and typically more than 250° C. The temperature of the waste heat can be lowered easily by mixing it with cold, ambient air or cooler process air. Drying of the pulp web on a drying cylinder—for example a Yankee—also involves a steam and condensate system, the drying cylinder being heated with the steam from the steam and condensate system. The condensate produced in the steam and condensate system is available at a pressure level above atmospheric pressure and can be used directly by relieving the pressure, i.e. reducing the pressure of the condensate to a lower level, whereby some of the condensate evaporates and the steam thus produced can be added to the drying air. Similarly, it is feasible to take steam directly from the steam and condensate system for mixing into the drying air. In the same way, waste heat from sub-systems, particularly a vacuum system, can be used. If vacuum blowers are used to generate a vacuum, exhaust air with a temperature of up to 150° C. is produced in the vacuum system. It is advantageous to use this process waste heat from the vacuum system directly to dry the pulp web in the area between the first transfer area and the second transfer area. In general, the process waste heat can be used directly and/or indirectly to set the temperature of the drying air, waste heat or air containing waste heat being used directly as drying air in direct use and waste heat being used indirectly to heat the drying air in indirect use. Indirect heating typically involves the use of heat transfer devices or heat exchangers to transfer the waste heat to the drying air. In addition, cooler process air or ambient air can be used to set a desired temperature of the drying air or to reduce the temperature of the drying air if it is too high.

The inventive embodiments also relate to a device for drying a pulp web, in particular a tissue web or sanitary paper web, according to the preamble of claim 6, characterized in that a drying device for thermal drying of the pulp web is disposed in the area between the first transfer area and the second transfer area. The quality characteristics of the pulp web can be retained better in the second transfer area, with the result that improved quality characteristics can be obtained overall in the pulp web.

A similarly advantageous embodiment of the device is characterized in that the drying device between the first transfer area and the second transfer area comprises a convection drying area and drying air can be applied directly to the pulp web by the drying device, where the drying air can be sucked back into the drying device in the convection drying area. Advantageously, the drying device also comprises a through-air drying area, where the drying air can be applied directly to the pulp web by the drying device, a suction device being disposed opposite the drying device in the through-air drying area and where at least a part of the drying air can be sucked into the suction device. Here, the transfer clothing runs between the drying device and the suction device in the through-air drying area, where the drying air can be applied directly to the pulp web from the drying device. The drying device is typically designed as a dryer hood or impact dryer hood, where the drying air can be applied directly to the pulp web through slot-type or hole-type nozzles. A suction device can be designed as a vacuum box or suction box, for example, or as a vacuum roll. If a vacuum roll is used, suction can be applied to the transfer clothing in the area where it is wrapped round the vacuum roll. By applying the drying air to the pulp web, the impulse of the drying air acts on the transfer clothing, applying force to the transfer clothing in flow direction of the drying air applied. The force acting on the transfer clothing causes the transfer clothing to sag in flow direction of the drying air applied. Hence, it is advantageous to design clothing stabilizer elements in the area of the suction device to limit sagging of the transfer clothing. Guide rolls can serve as clothing stabilizing elements, the guide rolls being provided on the side of the suction device and the transfer clothing being guided directly over the guide rolls. According to the spacing between the guide rolls, the transfer clothing is also supported with the same spacing and deflection of the transfer clothing is limited. In particular, the suction device can be disposed between the clothing stabilizing elements, e.g. suction boxes can be disposed between the guide rolls.

Another favourable embodiment of the device is characterized in that the drying device is connected directly or indirectly to a process waste heat duct in order to make use of process waste heat produced during thermal drying of the pulp web after the second transfer area and/or in sub-systems, especially in a vacuum system. A process waste heat duct of this kind can be assigned to a process, for example, comprising thermal drying of the pulp web after the second transfer area and/or a sub-system, particularly the vacuum system. Here, the waste heat and exhaust air from high-temperature hood drying has a temperature level of more than 200° C., and typically more than 250° C. The waste heat from a vacuum system, especially when using vacuum blowers to generate a vacuum, supplies exhaust air with a temperature of up to 150° C. In general, the process waste heat can be used directly and/or indirectly to set the temperature of the drying air.

BRIEF DESCRIPTION OF THE DRAWINGS

The invention will now be described using the examples in the drawings.

DETAILED DESCRIPTION

Figure 1:
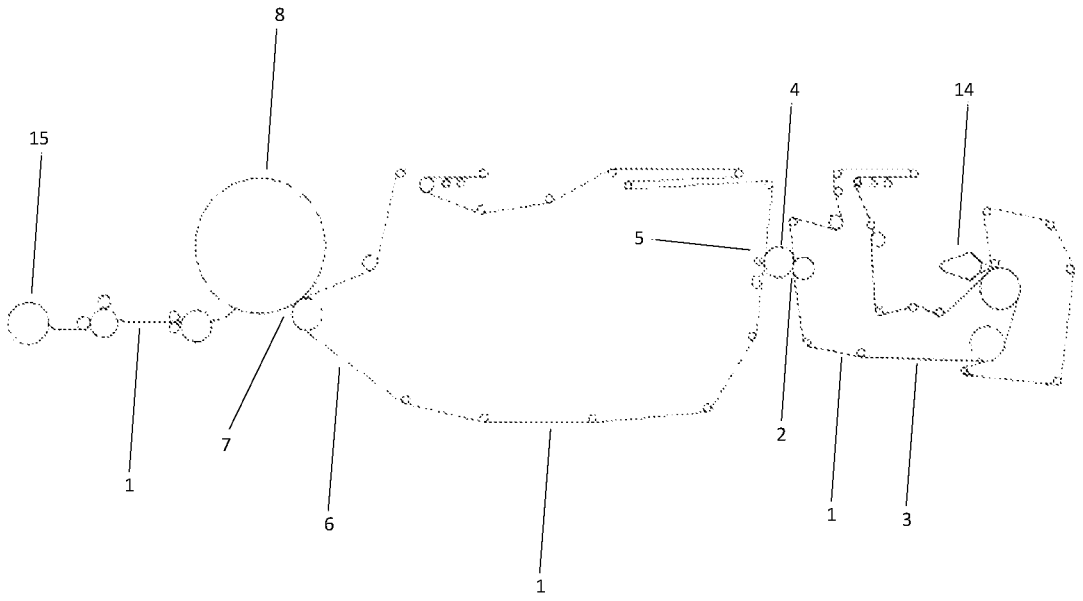
FIG. 1 shows a machine for production of a pulp web according to the state of the art.

FIG. 1 shows a device according to the state of the art for production of a pulp web 1, a pulp suspension being placed between two clothings via a headbox 14 and dewatered centrifugally. Here, the pulp suspension is placed between a first clothing 3—a felt—and a forming wire and dewatered. When a pulp web 1 has formed, the pulp web 1 is carried on the first clothing 3 to a first pressing area 2, where the pulp web 1 is pressed between the first clothing 3 and a rotating press belt 4. Here, the pulp web 1 is transferred to the rotating press belt 4 and carried directly on the press belt 4 out of the first pressing area 2 to a first transfer area 5, with transfer of the pulp web 1 in the first transfer area 5 from the rotating press belt 4 to a transfer clothing 6 followed by transfer of the pulp web 1 in a second transfer area 7 from the transfer clothing 6 to a drying cylinder 8. Drying of the pulp web 1 on the drying cylinder 8 is followed by reeling 15 of the pulp web 1.

Figure 2:
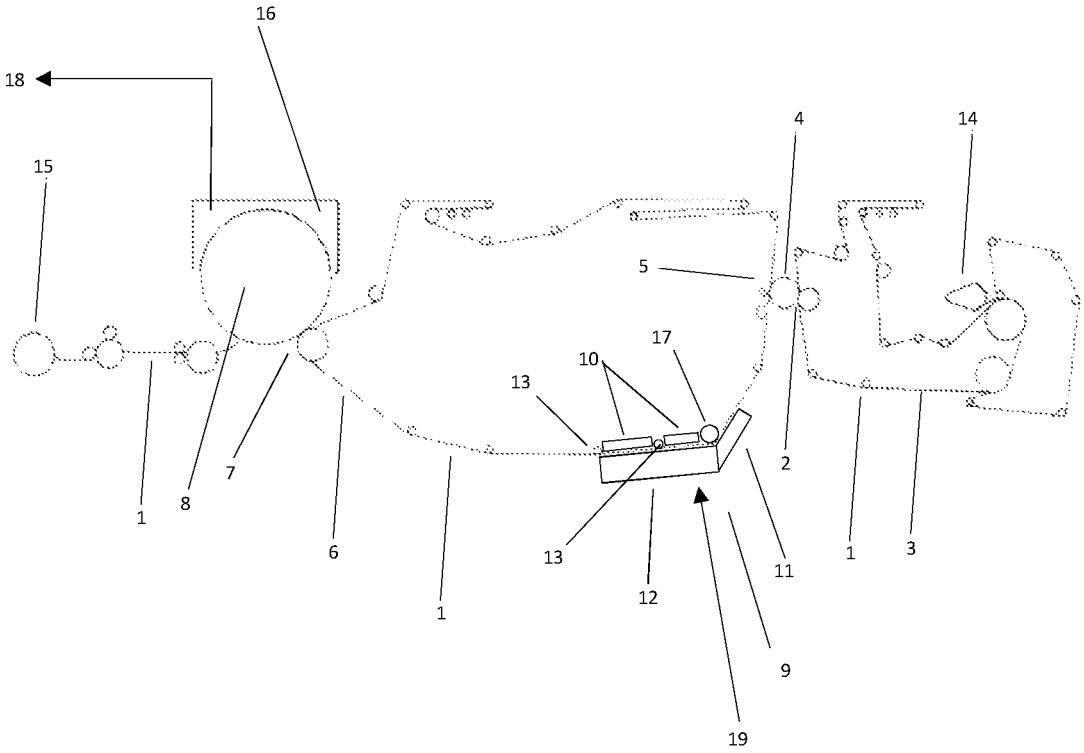
FIG. 2 shows an embodiment of a device for drying a pulp web.

FIG. 2 shows a plant for production of a pulp web 1 with the disclosed device for drying the pulp web 1. When a pulp web 1 has formed, the pulp web 1 is carried on the first clothing 3 to a first pressing area 2, where the pulp web 1 is pressed between the first clothing 3 and a rotating press belt 4. Here, the pulp web 1 is transferred to the rotating press belt 5 and carried directly on the press belt 4 out of the first pressing area 2, with transfer of the pulp web 1 in the first transfer area 5 from the rotating press belt 4 to a transfer clothing 6. Advantageously, the pulp web 1 is structured in the first transfer area 5, where structuring of the pulp web 1 takes place by transferring the pulp web 1 from the rotating press belt 4, revolving at a higher speed, to the transfer clothing 6, revolving at a lower speed, and the transfer clothing 6 being designed as a structured transfer clothing. According to the invention, thermal drying is applied after the first transfer area 5 and before a second transfer area 7, in which the pulp web 1 is transferred from the transfer clothing 6 to a drying cylinder 8. For thermal drying, drying air is applied by a drying device 9 directly to the pulp web 1. The drying device 9 also has a convection drying area 11. In the convection drying area 11, the drying air is applied directly to the pulp web 1 and sucked back into the drying device 9 again. The drying device 9 also has a through-air drying area 12, the drying air being applied directly to the pulp web 1 by the drying device 9, a first part of the drying air being sucked back into the drying device 9 after drying and a second part of the drying air being sucked through the pulp web into a suction device 10. Advantageously, clothing stabilizing elements 13 are provided in the area of the suction device 10. The clothing stabilizing elements 13 comprise guide rolls, where design as a suction roll 17 is also possible. The drying air is used directly and/or indirectly from process exhaust air. In this way, the exhaust air from the high-temperature drying hood 18, for example, can be used as a supply air drying device 19.

The present invention thus offers numerous advantages. It enables production of a pulp web with improved quality characteristics and with low energy consumption and thus low operating costs at the same time. Similarly, low capital expenditure is possible because the dryer for thermal drying of the pulp web can have a smaller design after the second transfer area.

REFERENCE NUMERALS (1) Pulp web
(2) First pressing area
(3) First clothing
(4) Rotating press belt
(5) First transfer area
(6) Transfer clothing
(7) Second transfer area
(8) Drying cylinder
(9) Drying device
(10) Suction device
(11) Convection drying area
(12) Through-air drying area (13) Clothing stabilizing element
(14) Headbox
(15) Reel
(16) High-temperature drying hood
(17) Clothing stabilizing element designed as a suction roll
(18) Exhaust air from high-temperature drying hood
(19) Supply air drying device

The invention claimed is:

1. A method for producing a pulp web (1), comprising dewatering the pulp web (1) by pressing the pulp web (1) in a first pressing area (2) between a first clothing (3) comprising a felt and a rotating press belt (4) with line loads between 80 kN/m and 600 kN/m;

transferring the dewatered pulp web (1) to the rotating press belt (4) with the pulp web (1) being guided directly on the press belt (4) out from the first pressing area (2) to a first transfer area (5);

transferring the pulp web (1) from the rotating press belt (4) to a transfer clothing (6) in the first transfer area (5); and transferring the pulp web (1) from the transfer clothing (6) to a drying cylinder (8) in a second transfer area (7); wherein the pulp web (1) is dried thermally between the first transfer area (5) and the second transfer area (7).

2. The method according to claim 1, wherein the pulp web (1) is structured in the first transfer area (5) by transferring the pulp web (1) from the rotating press belt (4) revolving at a higher speed to the transfer clothing (6) revolving at a lower speed, and wherein the transfer clothing (6) is a structured transfer clothing.

3. The method according to claim 1, wherein the thermal drying of the pulp web (1) on the transfer clothing (6) comprises convection drying of the pulp web (1), drying air being applied directly to the pulp web (1) by a drying device (9) and the drying air then being sucked back into the drying device (9).

4. The method according to claim 3, wherein the thermal drying of the pulp web (1) carried on the transfer clothing (6) further comprises through-air drying of the pulp web (1), wherein drying air is applied through the drying device (9) directly to the pulp web (1), a first part of the drying air being sucked back into the drying device (9) again and a second part of the drying air being sucked through the pulp web (1) into a suction device (10) with the transfer clothing (6) running between the pulp web (1) and the suction device (10).

5. The method according to claim 1, comprising applying drying air directly to the pulp web (1) between the first transfer area (5) and the second transfer area (7) for thermally drying the pulp web (1), wherein the temperature of the drying air is set by one or more of direct and indirect use of process waste heat produced during thermal drying of the pulp web (1) after one or both of the second transfer area (7) and sub-systems, particularly in a vacuum system.

6. The method of claim 1, wherein the pulp web (1) is a tissue or sanitary paper web.

7. A device for producing a pulp web (1), comprising:

a first clothing (3) and a rotating press belt (4) in a first pressing area (2) and configured for dewatering the pulp web (1) between the first clothing (3) and rotating press belt (4);

a transfer clothing (6) configured for transferring the pulp web (1) from the rotating press belt (4) to the transfer clothing (6) in a first transfer area (5), wherein the pulp web (1) is guided directly on the rotating press belt (4) between the first pressing area (2) and the first transfer area (5);

a drying cylinder (8) configured for transferring the pulp web (1) from the transfer clothing (6) to the drying cylinder (8) in a second transfer area (7); and a drying device (9) disposed in an area between the first transfer area (5) and the second transfer area (7) for thermally drying the pulp web (1).

8. The device according to claim 7, wherein the transfer clothing (6) is a structured transfer clothing (6) in the first transfer area (5), and wherein a speed of the structured transfer clothing (6) is slower than a circumferential speed of the rotating press belt (4) in the first transfer area (5).

9. The device according to claim 7, wherein the drying device (9) comprises a convection drying area (11) and drying air can be applied directly to the pulp web (1) by the drying device (9) and sucked back into the drying device (9) in the convection drying area (11).

10. The device according to claim 9, wherein the drying device (9) further comprises a through-air drying area (12) and a suction device (10) disposed opposite the drying device (9), wherein drying air is applied directly to the pulp web (1) by the drying device (9) and the suction device (10) sucks up at least a part of the drying air.

11. The device according to claim 10, comprising clothing stabilizing elements (13) in an area of the suction device (10), the clothing stabilizing elements (13) being disposed on a side of the suction device (10), wherein the transfer clothing (6) is guided between the drying device (9) and the clothing stabilizing elements (13).

12. The device according to claim 7, wherein the drying device (9) is connected directly or indirectly to a process waste heat duct, which thereby provides use of process waste heat produced during thermal drying of the pulp web (1) after one or both of the second transfer area (7) and sub-systems.

13. The device of claim 7, wherein the pulp web (1) is a tissue or sanitary paper web.

14. The device of claim 12, wherein at least one of said sub-systems is a vacuum system.

* * * * *